United States Patent [19]

Gavin

[11] Patent Number: 4,626,691

[45] Date of Patent: Dec. 2, 1986

[54] LIQUID-FILM ELECTRON STRIPPER

[75] Inventor: Basil F. Gavin, Albion, Calif.

[73] Assignee: The United States of America as represented by the United States Department of Energy, Washington, D.C.

[21] Appl. No.: 667,255

[22] Filed: Nov. 1, 1984

[51] Int. Cl.[4] ..... H01J 3/04

[52] U.S. Cl. ..... 250/423 R; 239/763/224

[58] Field of Search ..... 250/423 R, 424, 492.21; 239/701, 703, 224, 222.11

[56] References Cited

U.S. PATENT DOCUMENTS

| | | | |
|---|---|---|---|
| 2,166,772 | 7/1939 | Salsas-Serra | 239/224 |
| 3,867,704 | 2/1975 | Gorka | 328/233 |
| 4,453,077 | 6/1984 | Leeman et al. | 250/423 R |

FOREIGN PATENT DOCUMENTS

| | | | |
|---|---|---|---|
| 0869826 | 10/1981 | U.S.S.R. | 239/224 |

OTHER PUBLICATIONS

LBL-17996-Rev. Draft, Gavin, B. et al, "A Continuous Liquid Sheet Generator for Ion Stripping," Sep. 1984.

Perry, J. H., "Chemical Engineers Handbook," McGraw Hill (1963), pp. 18-66.

Alonso, J. R. et al., "Fluorocarbon Stripping of Low Beta Heavy Ions," IEEE Trans. on Nuc. Sci., vol. NS-26, No. 3, Jun. 79, 3718-20.

Thomas, G. E., "Carbon Stripper Foils For Heavy Ion Accelerators," IEEE Trans. on Nuc. Sci., vol. NS-28, No. 2, Apr. 81, 1584-87.

Leeman, B. T. et al., "A Liquid Film Stripper for High Intensity Ion Beams," IEEE Trans. on Nuc. Sci., vol. NS-28, No. 3, Jun. 81.

*Primary Examiner*—Bruce C. Anderson

*Assistant Examiner*—Paul A. Guss

*Attorney, Agent, or Firm*—L. E. Carnahan; Roger S. Gaither; Judson R. Hightower

[57] ABSTRACT

An improved liquid-film electron stripper particularly for high intensity heavy ion beams which produces constant regenerated, stable, free-standing liquid films having an adjustable thickness between 0.3 to 0.05 microns. The improved electron stripper is basically composed of at least one high speed, rotating disc with a very sharp, precision-like, ground edge on one said of the disc's periphery and with a highly polished, flat, radial surface adjacent the sharp edge. A fine stream of liquid, such as oil, impinges at a 90° angle adjacent the disc's sharp outer edge. Film terminators, located at a selected distance from the disc perimeter are positioned approximately perpendicular to the film. The terminators support, shape, and stretch the film and are arranged to assist in the prevention of liquid droplet formation by directing the collected film to a reservoir below without breaking or interfering with the film. One embodiment utilizes two rotating discs and associated terminators, with the discs rotating so as to form films in opposite directions, and with the second disc being located down beam-line relative to the first disc.

15 Claims, 4 Drawing Figures

LIQUID-FILM ELECTRON STRIPPER

The invention described herein arose in the course of, or under, Contract No. DE-AC03-76SF00098 awarded by the U.S. Department of Energy.

BACKGROUND OF THE INVENTION

The invention relates to the generating of liquid films, particularly to a method and apparatus for generating thin, free-standing liquid films for use as an electron stripper for an ion beam, and more particularly to an improved liquid-film electron stripper for high intensity heavy ion beams.

Producing a copious ion current with more than a few charges per ion in a typical ion source is very difficult. Hence, heavy charged particles have a low charge-to-mass ratio when leaving an ion source. Electron removal from these ions with a "stripper" to increase the charge of the ion, is feasible at a higher energy. Less power is needed to accelerate particles with a large charge-to-mass ratio. Examples of commonly used stripping devices are carbon-foils. Also, gas strippers have been developed, causing less energy straggling and less multiple scattering but producing lower average charge states than carbon-foil strippers that produce higher average charge states but are easily damaged by high intensity, particularly high mass beams. The lifetime of one of these carbon-foils can be as low as a few minutes when exposed to high intensity, high mass beams.

The use of thin, free-standing liquid films has been more recently developed as another means of solving the stripper foil lifetime problem. This technique was first introduced by J. C. Cramer et al wherein oil is spun from a sharp edge of a rotating disc. The sharp-edged rotating disc touches the surface of an oil reservoir and spins a thin film from the edge of the disc, with a thin scraper mounted so that it is tangent to, and almost touching, the rotating disc at a point within the oil-disc contact region. The scraper's functions were to increase the gradient of the shear forces in the liquid, to reduce the amount of oil retained on the disc for a given immersion depth, and to support the lower edge of the generated film, thereby increasing film stability.

An improvement to the Cramer et al device is described and claimed in U.S. Pat. No. 4,453,077 issued June 5, 1984 to B. T. Leeman et al, and assigned to the assignee of this invention. This improvement was composed of a disc with a centrally located, hollow-ground, razor-sharp, outer edge, the lateral surface of the edge being rough in order to grab the oil composing the liquid film. Care had been taken to make the drive mechanism of the disc vibration less to achieve film stability. The oil-disc contact comprises a fine oil stream ejected from a nozzle mounted above the disc, and the oil flows downward, tangentially touching the edge of the rotating disc. The device utilizes a scrapper consisting of a brush apparatus that actually touches the rotating disc and removes excess oil on the disc, thereby preventing the formation of undesired small drops of oil which spin off the disc and damage or destroy the liquid film formed by the rotating disc. Films on the order of 0.25 to 0.85 micron thick have been generated with the Leeman et al device.

While the prior art electron strippers have been effective, a need has existed for an electron stripper which produces constantly regenerated, stable, free-standing films having a thickness on the order of 4–5 time thinner than those produced by Cramer et al and Leeman et al.

Therefore, it is an object of this invention to provide an improved liquid-film electron stripper.

A further object of the invention is to provide a liquid-film forming apparatus, which produces liquid-films stable enough to be tested with an ion beam from a working accelerator.

A further object of the invention is to provide an apparatus for producing a film of liquid having a thickness in the range of 0.3 to 0.05 microns.

Another object of the invention is to provide an apparatus which produces constantly regenerated, stable, free-standing films of liquid, particularly applicable for use in an electron stripper for high intensity heavy ion beams.

Another object of the invention is to provide an improved electron stripper utilizing a disc having a razor-sharp edge formed on one side of a flat disc via a tapered surface forming the edge and with the flat surface being smooth and highly polished.

Another object of the invention is to provide an electron stripper utilizing a pair of rotating discs, one being down beam with respect to the other.

Other objects of the invention will become apparent to those skilled in the art from the following description and accompanying drawings.

SUMMARY OF THE INVENTION

To achieve the foregoing objects and advantages of the present invention, an apparatus is provided which has the capability of producing liquid films on the order of 0.3 to 0.05 microns thick, and which are particularly applicable for use as an electron stripper for high intensity heavy ion beams. The invention constitutes an improvement over the electron stripper of above-referenced U.S. Pat. No. 4,453,077 by providing a simply adjusted, stable, substantially (4–5 times) thinner liquid free-standing film which can be constantly regenerated. More specifically, the invention uses a different liquid feed and disc configuration. The liquid-film stripper uses a rotating flat disc having the peripheral edge cut in a taper to produce a razor-sharp edge on one side of the disk, with the radial surface of the disc being highly polished to provide a smooth surface. The disc's non-tapered edge receives the liquid from an adjacent nozzle. The smooth and highly polished surface of the disc minimizes excess liquid from being held, as well as minimizing oscillatory disturbances from surface variations while the liquid is adhering to the disc. Once at rest with respect to the disc, the only accelerating forces (acting on the fluid) are centrifugal and corriolis forces, free from pump pulsations.

Instead of the scrapers used in the prior stripper, the stripper of this invention utilizes film terminators located at selected distances from the disc perimeter and positioned approximately perpendicular to the film. The terminators support, shape, and stretch the film, and assist in the prevention of liquid droplet formation by directing the collected film to a reservoir below without breaking or interfering with the film.

In one embodiment a pair of strippers are used, with the second stripper being located down the beam-line from the first stripper; the two strippers being rotatable in a plane parallel to the beam line. The impingement of the beam on the films results in an elliptical cross section, and thus provides a greater surface area for stripping electrons from the beam.

DETAILED DESCRIPTION OF THE INVENTION

The invention is an improved liquid-film electron stripper used, for example, in stripping electrons from high intensity heavy ion beams, such as in the so-called "ABEL" beam-line at the Super Hilac system located at the University of California, Lawrence Berkeley Laboratory. The improved stripper has the capability of producing constantly regenerated, easily adjusted, stable, free-standing films of about 60 $cm^2$, with an adjustable thickness of between 0.3 to 0.05 microns, a reduction in film thickness on the order of 4–5 times over the film thickness of prior liquid-film strippers. The stripper of this invention has been tested using ions of niobium, holminum, and gold. By way of example, an embodiment is composed of a 8.5 cm diameter, high speed, rotating disc made of stainless steel, with a very sharp, precision-like, ground edge with a highly polished, flat, radial surface. A fine stream of oil, for example, emerging from a 1.2 mm diameter nozzle, impinges on the flat polished surface of the disc at about a 90° angle, about 0.5 cm from the disc's sharp outer edge. Film terminators, located a distance approaching 3 to 18 cm from the disc perimeter and fabricated from stainless steel ribbon, are positioned approximately perpendicular to the film formed by the rotating disc. The terminators support, shape, and stretch the film. These terminators are arranged in such a way as to both stabilize the film to a certain thickness and to assist in the prevention of fluid droplet formation by directing the collected film to a reservoir below without breaking or interfering with the film. The formed films are very fragile when in their thinnest mode. Consequently, careful filtering of the liquid (oil) is essential.

An ion beam has sufficient force to generate a hole in the liquid film. The hole never increases in size on the upstream side because the film is regenerated by additional constantly supplied fluid that brings the thin film directly to the ion beam boundary. The downstream side of the hole enlarges from surface tension forces and is swept away until it disappears at the film's lower edge. This is accomplished within one complete revolution of the disc. The embodiment utilizing two rotating discs functions to minimize the increase in hole size by directing the film in opposite directions.

Figure 2:
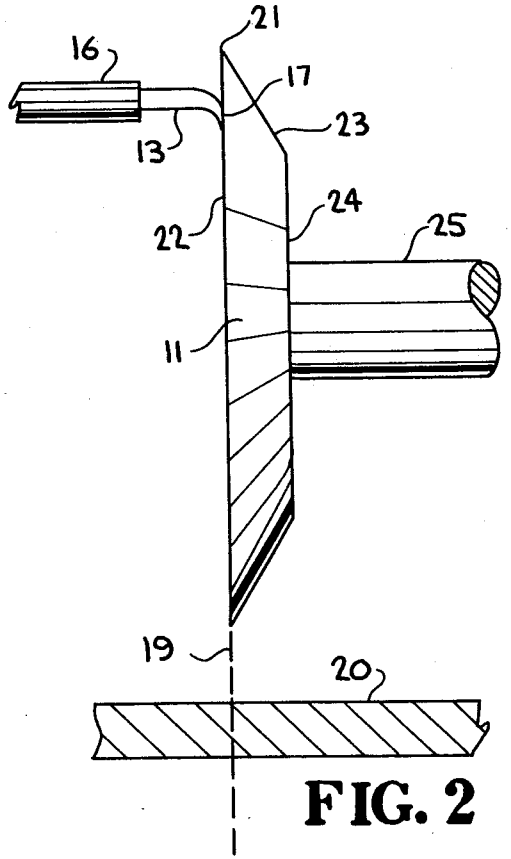
FIG. 2 is an enlarged end view of a section of the FIG. 1 electron stripper illustrating the configuration of the rotating disc and liquid supply therefor.
Figure 1:
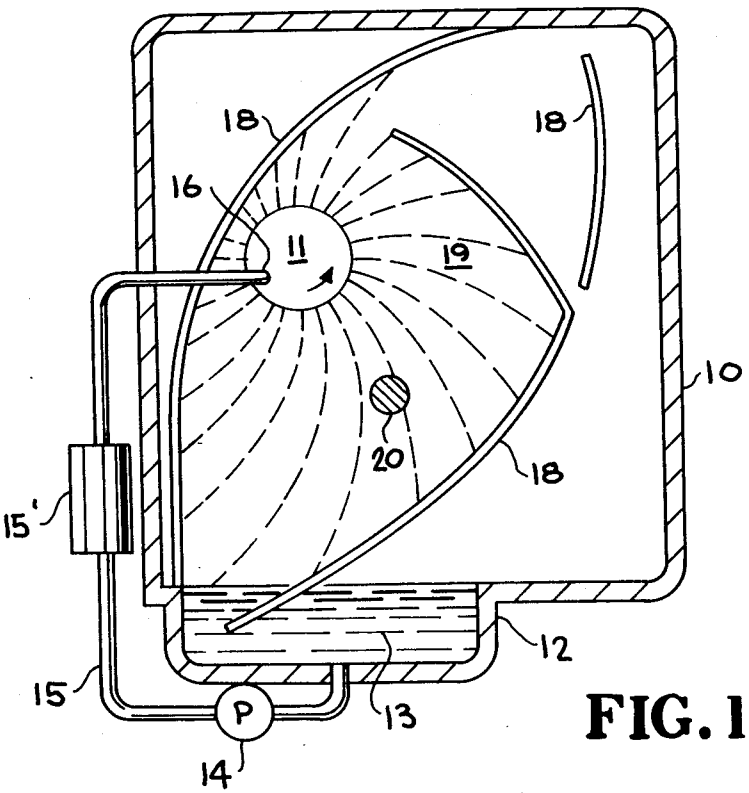
FIG. 1 is a schematic illustration of an embodiment of an electron stripper made in accordance with the invention.

Referring now to the single rotating disc embodiment illustrated in FIGS. 1 and 2, it can be readily seen that the electron stripper of this invention differs from the stripper of above-referenced U.S. Pat. No. 4,453,077 primarily in the configuration of geometry of the rotating disc, the use of film terminators, and the manner in which the liquid is directed onto the disc. The embodiment of the stripper illustrated in FIGS. 1 and 2 basically comprises a housing 10 in which a disc 11 is rotatably mounted, reservoir 12 containing a fluid or liquid 13 is located at the bottom of housing 10 and liquid, such as oil, is directed by a pump 14 through a conduit or tube 15 and filter 15' which terminates in a nozzle 16 located adjacent disc 11 and liquid 13 impinges on disc 11 as indicated at point 17. A plurality of terminators 18 (three in this embodiment) are mounted to housing 10 at selected distances from the perimeter of disc 11, and approximately perpendicular to a liquid film, indicated at 19, through which a beam line 20 passes.

As seen in FIG. 2, the disc 11, made of stainless steel, for example, is provided with a razor-sharp, ground edge 21 that is free from any imperfections. The disc 11 is perfectly flat on one side 22 and is provided with a tapered surface 23, extending at an angle of about 30°–45°, for example, on the outer portion of an opposite side 24, the tapered surface 23 drawing to form the razor-sharp edge 21. At least the outer radial section or surface of side 22 is smooth and highly polished, particularly at the radial area of liquid impingement point 17, and functions to minimize excess liquid from being picked up and to minimize oscillatory disturbances from surface variations while the liquid is adhering to the disc 11. The adhesive forces between the liquid 13 and disc 11 are sufficient to allow for nearly full acceleration (now about 95%) of the liquid. A disc drive mechanism, generally indicated at 25, is constructed so as to drive the disc 11 essentially vibrationless to achieve film stability. An example of such a drive mechanism is shown in above-referenced U.S. Pat. No. 4,453,077. For example, the disc 11 may be supported by two roller bearings and driven by a shaft connected via a magnetic clutch to a variable-speed motor outside a vacuum chamber in which housing 10 is located. The disc drive mechanism 25 is constructed so as to rotate the disc 11 at a speed in the range of 8,000–9,000 rpm.

Liquid or fluid 13 is in the form of a fine stream as it emerges from nozzle 16 and impinges at point 17 of the radial outer, smooth surface of side 22 of disc 11 at approximately a 90° angle, as shown in FIG. 2. For example, the nozzle 16 has a 1.2 mm diameter and the impingement point 17 is about 5 mm from the edge 21 of disc 11 (in a radially inward direction). A centrifugal pump 14, for example, provides the liquid circulation from reservoir 12 through conduit 15 to nozzle 16, the position of nozzle 16 being fully adjustable with respect to the rotating disc 11. The liquid filtering mechanism, indicated at 15', is used to filter impurities and dust particles, etc., from the recirculated liquid before its re-use, eliminating potential interference from the liquid film production. As the disc 11 rotates, liquid 13 is continuously dumped due to the centrifugal motion, thus producing progressively thinner films as the disc rotates toward full rotation. When approaching 320 degrees of rotation from initial liquid impingement, the generated films 19 become useful for electron stripping. The liquid is constantly being accelerated from 0% (since liquid strikes the disc at 90°) to about 95% of the disc perimeter velocity. Perhaps 4% of the liquid is retained at 300 degrees of rotation, producing films on the order of 0.05 micron thickness in the critical area where the beam 20 penetrates the film 19.

The film 19, formed by rotation of disc 11, is supported and shaped by film terminators 18 that stretch the film out from a small space where a terminator is located close to disc 11 to a larger space where the distance between the disc and a terminator is greater. The terminators 18 also contribute greatly to the film's stabilization. The terminators are, for example, fabricated from stainless steel ribbons having dimensions of about 1 cm wide and 0.5 mm thick, but these dimensions are not critical. The FIG. 1 embodiment uses two large (long) terminators and one small (short) terminator. The terminators 18 are placed at an appropriate distance from the disc 11 and at angles essentially perpendicular to the film 19. This distance can be in the range from 3 cm to about 18 cm from the disc, and this distance is one of the factors that affects the film's stability and thickness. The curvature of each of the terminators is dependent on the area and thickness of the film to be formed. As pointed out above, stable, free-standing films 19 of about 60 $cm^2$ with a thickness of 0.3–0.05 microns have been formed with an embodiment similar to that illustrated in FIGS. 1 and 2.

If droplets due to excess liquid tend to form at the interface between the film 19 and a terminator ribbon 18, the terminators can be adjusted to slightly change the tilt and angle with respect to true vertical on the terminator. By appropriately tilting the terminator ribbon, the formed droplets will be conducted along the terminator's surface and directed to the reservoir 12 without breaking or interfering with the film 19. Means for adjusting the tilt angle of the terminators could be incorporated into the mounting or support mechanisms.

An ion beam from an associated accelerator, not shown, travels along beam line 20 and punctures the film 19 leaving a hole in it. The hole in film 19 never increases in size on the upstream side (side facing the direction in which the liquid is spun off of disc 11), since the film is continuously regenerated by additional constantly supplied liquid, thus retaining the capability of bringing a thin film directly into the ion beam boundary. The downstream side hole in the film formed the beam enlarges under surface tension forces once a hole is formed. Because the film is moving away from the beam line or axis, the hole is swept away at the same time it is being generated. The hole on the downstream side of the beam enlarges until it completely disappears at the film's lower edge. This is accomplished continuously whenever an ion beam is being directed through the film 19.

Successful film generation requires a liquid with a very low vapor pressure, for example, not exceeding $10^{-7}$ mm. A preferred liquid is a perfluoropolyether, known as FOMBLIN® and made by Montedison, having a viscosity of 180 centistoke. As known in ion beam electron stripping, the stripper is located in a vacuum chamber, and vacuum pressure will increase in the region where the beam strikes the film. Liquid vaporization will contribute to the vacuum degradation, but only that liquid vaporized by the ion beam effects the vacuum degradation and not the large liquid quantities collected in the stripping apparatus. These small vaporized quantities do not constitute a serious problem. If desired, liquid nitrogen traps may be located in the vicinity of the film which further aids in the collection of this small amount of vapor.

Figure 4:
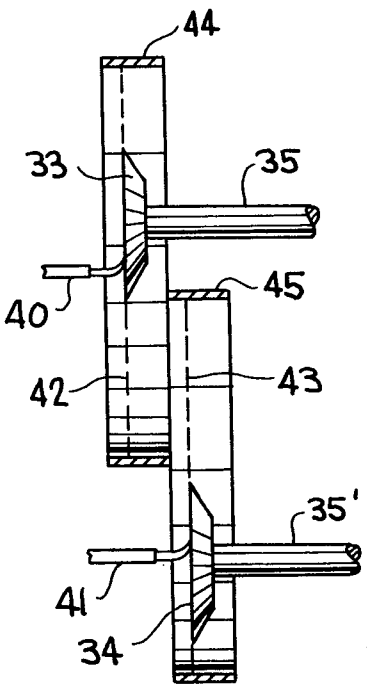
FIG. 4 is an end view of a section of the FIG. 3 electron stripper.
Figure 3:
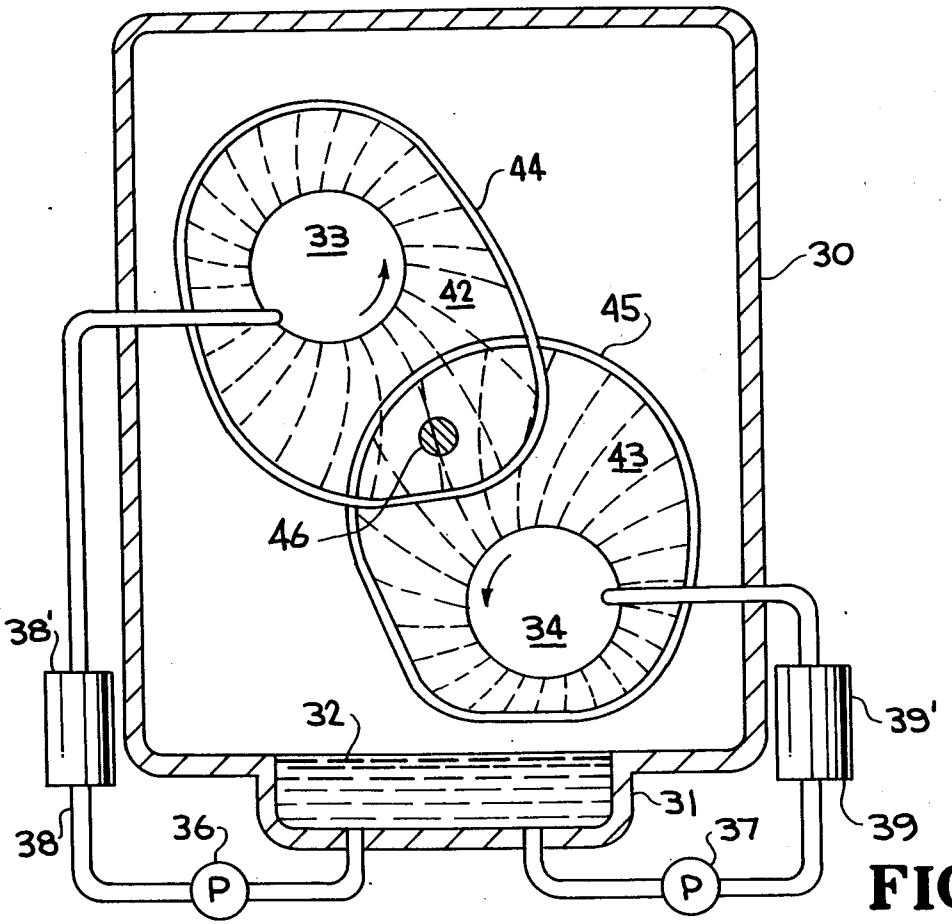
FIG. 3 schematically illustrates another embodiment of the invention utilizing a pair of rotating discs.

It has been postulated that most of the electron stripping takes place on the upper portion of the beam-line 20 where the film 19 is in continuous contact with the ion beam boundary. Locating an additional stripper further down the beam-line relative to the first stripper would improve the electron stripping capability. In this way, electrons from the beam-line's lower portion would be stripped in equal quantities to the upper portion. An embodiment of a dual disc stripper is illustrated in FIGS. 3 and 4 and described in detail hereinafter. Also, an adjustment of the angle of film plane to beam axis can be accomplished by rotation of the disc axis, as described hereinafter, bearing in mind that a longer contact surface and thicker films exist with angles less than 90 degrees as the beam passes through the film.

Referring now to the dual disc embodiment of FIGS. 3 and 4, the stripper basically comprises a housing 30 having a reservoir 31 at the lower end containing a film producing liquid 32. A pair of discs 33 and 34 are mounted in housing 10 and are driven by mechanism 35 and 35', as indicated by the arrows. The discs 33 and 34 are each constructed similar to the disc of the embodiment of FIGS. 1 and 2. Liquid 32 from reservoir 31 is directed by pumps 36 and 37 through conduits or tubes 38 and 39, via filters 38' and 39', which terminate in nozzles 40 and 41, and impinges on the rotating discs 33 and 34, as described above with respect to the FIG. 1 embodiment, whereby films 42 and 43 are formed. Terminators 44 and 45 are located with respect to discs 33 and 34, and function to form and shape the films 42 and 43 as above described. A beam line passing through films 42 and 43 is indicated at 46. As shown more clearly in FIG. 4, disc 34 is located further down the beam-line with respect to disc 33. Note that the films 42 and 43 are formed such that they impact on opposite sides of the beam line 46.

Locating the second stripper (disc 34 and terminator 45) further down the beam-line 46 with respect to the first stripper (elements 34 and 44) and forming the film 43 in a direction opposite the direction of formation of the film 42 results in stripping electrons from the lower portion (back portion as shown in FIG. 3) of the beam in quantities equal to its upper portion.

While not shown, the discs of the FIGS. 3–4 embodiment may be rotated with respect to the axis of the beam-line so that the impingement of the beam on the films results in an elliptical cross section, and thus results in a greater surface area for stripping. Also, the thickness of the films can, from rotation, be increased by at least a factor of three. Further changes in thickness are achieved by tuning the disc rotation speed and the initial fluid contact on the disc.

It has thus been shown that the invention provides an improved liquid-film electron stripper, particularly adapted for high intensity heavy ion beams. The improved stripper is capable of producing constantly regenerated, stable, free-standing films of about 60 $cm^2$, the adjustable thickness of which is about 0.3 to 0.05 microns.

While particular embodiments of the invention have been illustrated and described, modifications and changes will become apparent to those skilled in the art, and it is intended to cover in the appended claims all such modifications and changes as come within the scope of this invention.

What is claimed is:

1. Means for forming a film of liquid having a thickness of about 0.3 to 0.05 microns, comprising:

a disc having a substantially flat surface on one side thereof, a tapered section on an opposite side forming a sharp edge at a peripheral portion of said flat surface, and at least an outer radial section of said flat surface being smooth, means for rotating said disc, means for directing a liquid onto said smooth outer radial section of said disc, whereby rotation of said disc causes liquid to be spun from said sharp edge of said disc forming a film of liquid about said disc, said liquid directing means including a nozzle positioned adjacent to said smooth outer radial section of said disc such that liquid from said nozzle impinges at about a 90 degree angle with respect to said flat surface of said disc, and means located in spaced relation with respect to said disc for shaping the film of liquid and consisting of at least one strip of material located at a selected distance from said disc and positioned substantially perpendicular to the film of liquid.

2. The liquid film forming means of claim 1 wherein said liquid directing means additionally includes a liquid reservoir, a pump connected to said reservoir, and conduit means interconnecting said pump with said nozzle, said liquid reservoir being adapted to collect liquid spun off of said disc.

3. The liquid film forming means of claim 1, wherein said at least one strip of material constitutes at least one metal ribbon located a distance of about 3–18 cm from said sharp edge of said disc.

4. A method of forming a thin film of liquid, comprising the steps of:

forming a disc so as to include a flat, smooth radial outer section on one side and a tapered section on an opposite side so as to form a sharp edge at the periphery of the flat, smooth section of the one side;

rotating the disc;

directing a liquid onto the flat, smooth radial outer section of the one side of the disc at a point adjacent the sharp edge, such that the liquid is first brought to rest on the disc and then spun off of the sharp edge of the disc forming a liquid film having a thickness in the range of 0.3 to 0./05 microns; and positioning at least one liquid film terminator comprising a ribbon of material at a selected distance from the disc which functions to support, shape, and stretch the liquid film.

5. The method of claim 4, wherein the step of directing a liquid onto the disc is carried out such that the liquid impinges at about a 90 degree angle with respect to the flat, smooth section of the disc.

6. The method of claim 4, additionally including the steps of forming the at least one liquid film terminator from a ribbon of material and positioning same approximately perpendicular to the liquid film.

7. The method of claim 4, additionally including the steps of rotatably mounting the disc in a housing, and directing an ion beam through the liquid film for stripping electrons from the ion beam.

8. The method of claim 7, additionally including the step of mounting at least one liquid film terminator in the housing at a selected distance from the disc for shaping the liquid film.

9. The method of claim 7, additionally including the steps of mounting a second rotatable disc configured as the first-mentioned disc in the housing at a location spaced with respect to said first-mentioned disc, rotating the second disc, and directing a liquid against the second disc for forming a second liquid film.

10. The method of claim 9, wherein the step of mounting the second disc is carried such that the second liquid film is axially spaced from the first-mentioned liquid film but such that a portion of said liquid films form an overlapping area through which the ion beam is directed.

11. The method of claim 10, wherein the liquid is directed onto each of the rotating discs such that the liquid impinges at about a 90° angle with respect to the flat, smooth section of the discs.

12. The method of claim 11, wherein at least one of the discs is rotated at an angle with respect to a longitudinal axis of the ion beam passing through the liquid films, such that impingement of the ion beam on the films results in an elliptical cross section providing a greater surface area for stripping electrons from the ion beam, as well as increased thickness of the film.

13. An improved liquid-film electron stripper for high intensity heavy ion beams comprising:

at least one rotatable disc mounted in a housing, means for rotating said disc, a liquid reservoir operatively connected to said housing, means for directing liquid from said reservoir onto said rotatable disc for forming a film of liquid as liquid is spun from said disc, said disc being configured to define a sharp edge located at one side of the periphery of said disc, and configured to include a flat, smooth radially outer section located adjacent said sharp edge, said liquid being directed onto said flat, smooth section of said disc, said means for directing liquid onto said disc including a nozzle positioned with respect to said disc so that liquid from said nozzle impinges at about a 90° angle with respect to said flat, smooth surface of said disc, and liquid film terminator means located in spaced relation to said disc and approximately perpendicular to a formed liquid film, said terminator means comprising at least one ribbon of material secured to said housing.

14. The electron stripper of claim 13, additionally including a second rotatable disc positioned in said housing in spaced relation to said first-mentioned rotatable disc, said second rotatable disc being configured substantially identical to said first-mentioned disc, means for rotating said second disc, means for directing liquid onto said second disc for forming a second liquid film, and liquid film terminator means located in spaced relation to said second disc.

15. The electron stripper of claim 14, wherein said second rotatable disc is located in an axially spaced position with respect to said first-mentioned disc so that the second liquid film is spaced from the first-mentioned liquid film but having sections of said films overlapping relative to a longitudinal axis passing therethrough, along which a beam of ions to be stripped of electrons is passed.

* * * * *